US005217386A

United States Patent [19]

Ohsumi et al.

[11] Patent Number: 5,217,386

[45] Date of Patent: Jun. 8, 1993

[54] SCREW FASTENING TYPE ELECTRICAL CONNECTOR

[75] Inventors: Hideki Ohsumi; Hidehiko Kuboshima; Yuji Hatagishi, all of Shizuoka, Japan

[73] Assignee: Yazaki Corporation, Tokyo, Japan

[21] Appl. No.: 883,399

[22] Filed: May 15, 1992

[30] Foreign Application Priority Data

May 21, 1991 [JP] Japan ..... 3-35855[U]

[51] Int. Cl.[5] ..... H01R 13/627

[52] U.S. Cl. ..... 439/364; 439/248; 439/638

[58] Field of Search ..... 439/34, 364, 246-252, 439/540, 638, 362, 359, 361, 363, 365

[56] References Cited

U.S. PATENT DOCUMENTS

| | | | |
|---|---|---|---|
| 4,780,090 | 10/1988 | Sugiyama et al. | 439/540 |
| 4,889,500 | 12/1989 | Lazar et al. | 439/364 |
| 4,923,411 | 5/1990 | Hayashi et al. . | |
| 4,956,748 | 9/1990 | Yamamoto et al. | 439/540 |
| 5,000,693 | 3/1991 | Hatagishi et al. | 439/248 |

FOREIGN PATENT DOCUMENTS 2-285906 11/1990 Japan .

*Primary Examiner*—Larry I. Schwartz
*Assistant Examiner*—Hien D. Vu
*Attorney, Agent, or Firm*—Armstrong, Westerman, Hattori, McLeland & Naughton

[57] ABSTRACT

An electrical connector assembly of the type including a first connector having a nut therein and a second connector having a bolt adapted to be threaded to the first connector to secure the first and second connectors together. One connector 8 is provided in the form of an outer housing having accommodation chambers 3 and 4 and an engaging portion 26 to receive a mating connector. The chambers 3 and 4 have first openings 18 through which inner housings 5 and 6 having horizontal support portions 30 are inserted. The accommodation chambers 3 and 4 are provided with flanges 19 at second openings 17 which stop or limit insertion of the inner housings. A spacer 7 is insertable in the outer housing to support the inner housings by engagement against the horizontal support of the inner housings.

5 Claims, 5 Drawing Sheets

SCREW FASTENING TYPE ELECTRICAL CONNECTOR

BACKGROUND OF THE INVENTION

The present invention relates to a screw fastening type electrical connector in which a connector composed of an outer housing and an inner housing accommodated in said outer housing is securely engaged with a mating connector.

In FIG. 8, the outside view of a screw connector disclosed in Japanese Patent Application Laid-Open-to-Public No. 2-285906 is shown in perspective. FIG. 9 is a cross section of FIG. 8 taken along the line 9—9 and additionally showing the mating connector positioned to be engaged therewith.

A connector box body 45 is formed therethrough with a accommodation chamber 46, in which a female connector 48 having therein a plurality of terminals 47 is accommodated further therewithin. Said female connector includes a housing 49 having a nut 50 provided therein into which a bolt 56 of a mating male connector 51 shown in FIG. 9 is screwed to secure the connectors 48 and 51.

Said female connector housing 49 has opposite outer side walls provided with a pair of flexible lock arms 53 slanting downwardly. Said lock arms 53 are formed at respective ends thereof with abutments 55 to abut against shoulders 54 at lower portions of the chambers 46 of the connector box body 45. Said female connector 48 is secured within the accommodation chamber 46 of the connector box body by means of said pair of lock arms 53.

In the above conventional structure, however, excessive pressing of the female connector 48 against the mating male connector 54 causes the lock arms 53 to deform, allowing the connector 48 to tilt to such an extent that the bolt 56 and the nut 50 can fail to be screwed properly.

SUMMARY OF THE INVENTION

In order to overcome the above shortcoming, the object of the present invention is to provide a screw connector which assures the positive engagement of the connector within a connector box body or an outer housing.

Therefore, there is essentially provided a screw fastening type electrical connector assembly comprised of a first connector having a nut therewithin and a second connector having a bolt extending therethrough and adapted to be connected to the first connector through bolt/nut screw fastening, said first connector comprising inner housing means having a support portion extending to perpendicularly cross an axial direction; outer housing means having at least one accommodation chamber opening at first and second axial ends, said outer housing means receiving said inner housing means from said first axial end, said second axial end having a projection to stop said inner housing means, said outer housing means having a spacer insertion aperture in communication with said at least one accommodation chamber; and a spacer to be inserted into said accommodation chamber through said spacer insertion aperture to abut against said support portion and support said inner housing means in a direction perpendicular to said axial direction.

DETAILED DESCRIPTION OF THE EMBODIMENT

Figure 1:
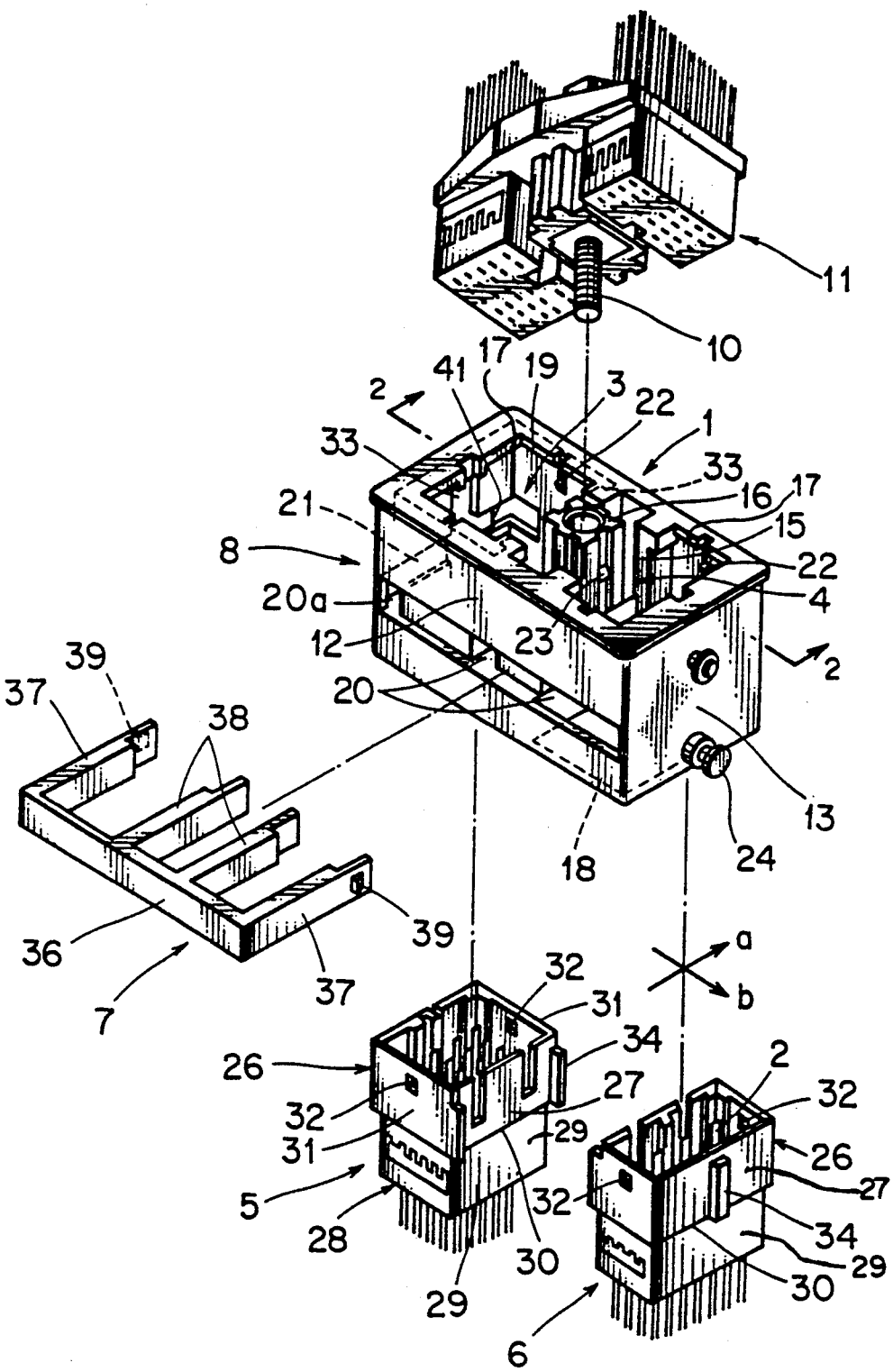
FIG. 1 is an exploded perspective view of one embodiment of the present invention.
Figure 2:
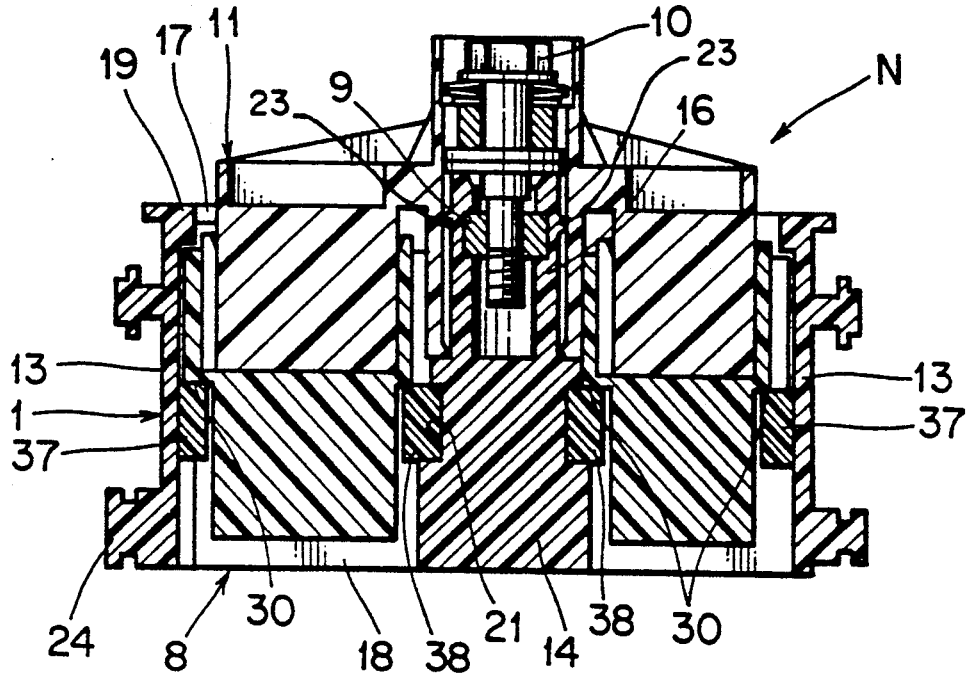
FIG. 2 is a sectional view of FIG. 1 taken along the line 2—2 to show the engaged state of the connectors.
Figure 3:
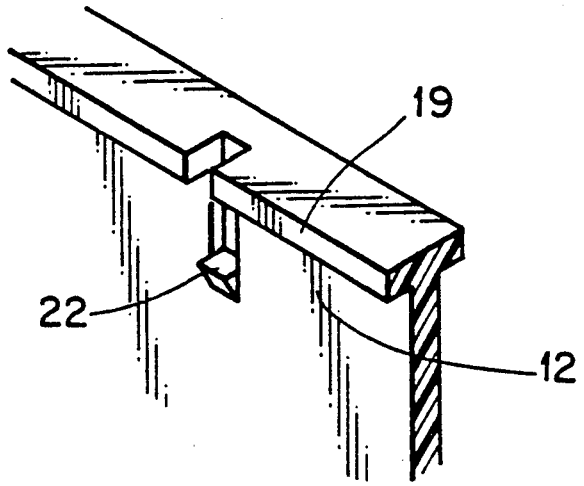
FIG. 3 is an enlarged perspective view of a provisional lock pawl formed in the outer housing.

A screw-fastening type electrical connector which is one embodiment of the present invention is shown in an exploded perspective in FIG. 1 whereas its engaged state is shown in a section in FIG. 2.

Said screw-fastening type connector N comprises a mounting type female connector 8 and a mating male connector 11. Said female connector 8 is comprised of an outer housing 1 of a synthetic resin material, inner housings 5 and 6 which accommodate terminals 2 therein and are inserted from below into accommodation chambers 3 and 4 of the outer housing 1. A spacer 7 of synthetic resin material which is inserted and securely engaged within the accommodation chambers 3 and 4. The male connector 11 is provided with a threaded bolt 10 aligned to be received in a nut 9 formed in the outer housing 1.

The outer housing 1 has rectangular front and rear walls 12 and square side walls 13 to define an interior, where a partition wall 14 is formed to connect the front and rear walls 12. Elongate guides 15 are formed to guide the mating connector 11. The partition wall 14 is integrally formed with a tower 16. The accommodation chambers 3 and 4 are thus defined by the foregoing elements for receiving the inner housings 5 and 6. The accommodation chambers 3 and 4 are open at upper and lower ends. At upper ends, the accommodation chambers 3 and 4 have openings 17 which are formed with flanges 19 to act as stops while at lower ends the accommodation chambers have openings 18 to receive inner housings therethrough. The front wall 12 is formed with a spacer insertion aperture 20. The side walls 13 and partition wall 14 are formed with insertion grooves 21 in communication with the spacer insertion aperture 20.

The upper inner wall surfaces of the front and rear walls 12 of the accommodation chambers 3 and 4 are formed with provisional lock pawls 22, respectively. The tower 16 is formed with pawls 23 for engaging the mating male housing 11. Cylindrical projections 24 are formed on both side walls 13 for installation thereof to a frame body to be mounted on (not shown).

Figure 4:
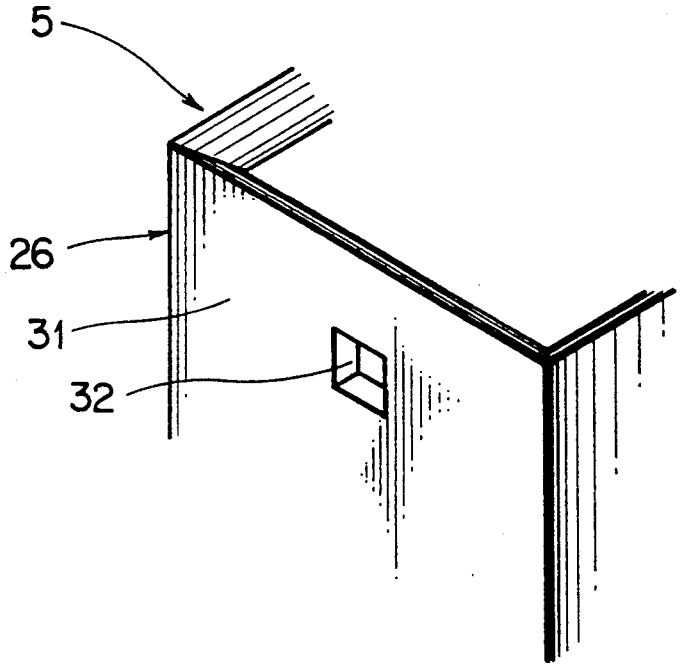
FIG. 4 is an enlarged perspective view showing an inner housing engagement hole corresponding to the provisional lock pawl.
Figure 5:
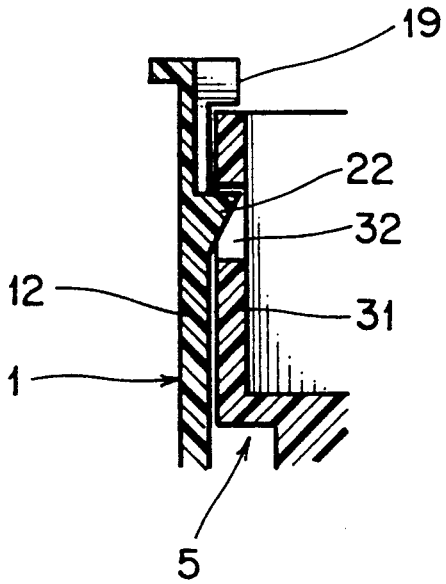
FIG. 5 is a longitudinal cross section of the inner housing in a provisionally locked state.
Figure 6:
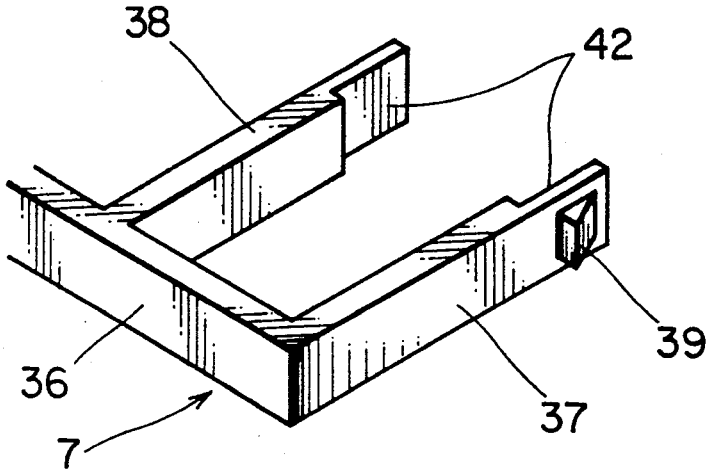
FIG. 6 is an enlarged perspective of the major portion of the spacer.

The inner housings 5 and 6 include engagement portions 26 defined by outer walls 27 for receiving said mating connector 11 and terminal chambers 28 defined by walls 29 for accommodation of terminals such that shoulders 30 are formed between the walls 27 and 29 for horizontal support thereof, that is, perpendicularly to the axial direction. Further as shown in FIG. 4, the front and rear walls 31 of the engagement portions 26 of the inner housings 5 and 6 are formed with relatively large engagement holes 32 for receiving the provisional lock pawls 22 formed in the outer housing 1 while the outer walls 27 are formed with elongate engagement members 34 in correspondence to the guide grooves 33 in the accommodation chambers 3 and 4.

With terminals loaded therein, said inner housings 5 and 6 are inserted into the accommodation chambers 3 and 4 through the lower openings 18 until provisional lock pawls 2i are provisionally engaged into the engagement holes 32 for provisional lock.

The outer walls 27 and 32 of the respective inner housings 5 and 6 are sized to provide slight gaps between themselves and inner surfaces of the walls 12 and 13 of the accommodation chambers 12 and 13 to allow displacements in directions a and b as shown in FIG. 1. As a result, the inner housings 5 and 6 are permitted to make axial alignment for smooth connection at the time of insertion of the mating connector 11 after insertion of the spacer 7.

The spacer 7 is comprised of a press bar 36, two pairs of support plates 37 and 38 projecting laterally from the press bar 36. The support plates 37 and 38 are adapted to engage against the horizontal support shoulders 30.

Figure 7:
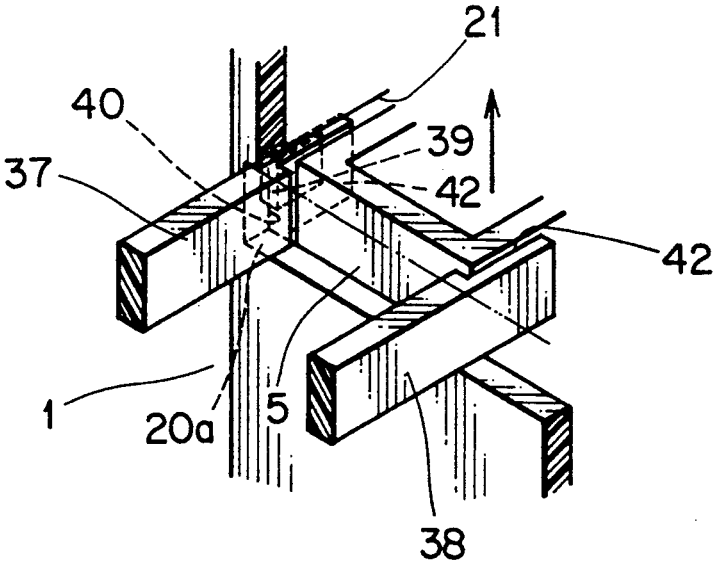
FIG. 7 is a perspective view showing the state in which the inner housing is inserted while the spacer is in a provisionally locked condition.
Figure 8:
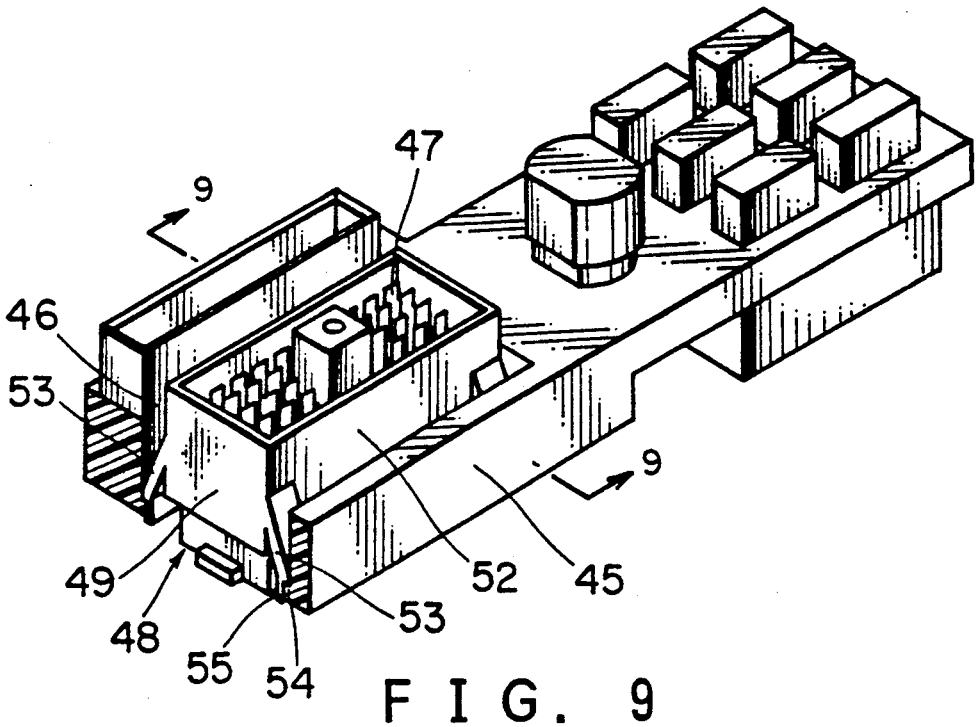
FIG. 8 PRIOR ART
FIG. 8 is a perspective view of the conventional screw-fastening type connector.
Figure 9:
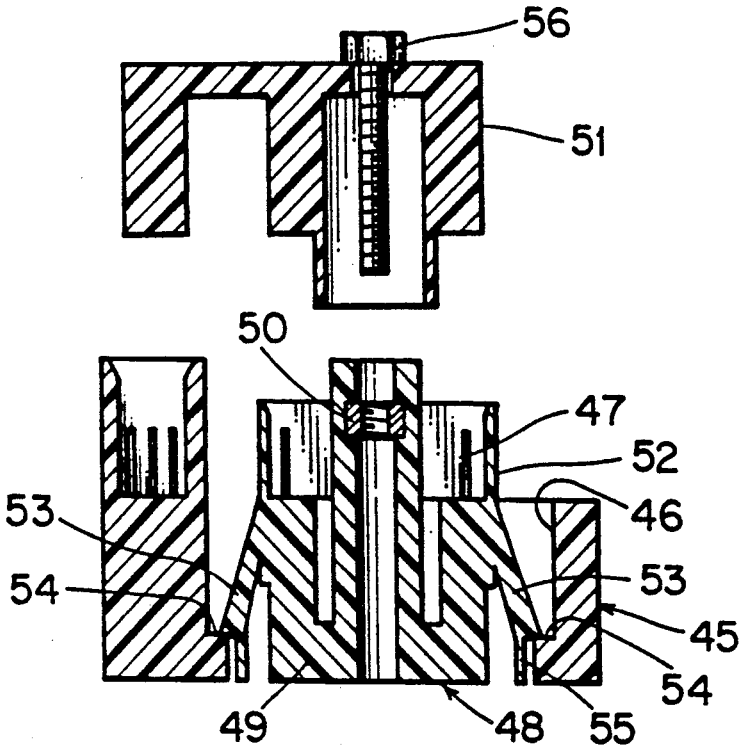
FIG. 9 PRIOR ART
FIG. 9 is a cross section of the same connector which is in a position to be connected taken along the line 9—9 of FIG. 8.

The support plates 37 of the spacer 7 are formed at tips thereof with lock pawls 39. The entrance 20*a* of the spacer insertion aperture 20 is formed with shoulders 40 which engage the lock pawls 39 as shown in FIG. 7. Further, final engagement shoulders 41 are formed at the far end of the grooves 21 extending from the spacer insertion aperture 20. The end portions of the support plates 37 and 38 are formed with cutouts 42 giving room to avoid interference at the time of inserting the inner housings 5 and 6 while the spacer is provisionally engaged with the outer housing 1.

Therefore, the spacer 7 is capable of being fully inserted and engaged with the outer housing 1 or being engaged therewith when only partly inserted with the result that the partly inserted spacer will not slip off to fall from the outer housing when the inner housings 5 and 6 are inserted into the accommodation chambers 3 and 4 from below the lower openings 18.

The inner housings 5 and 6 are provisionally locked by engagement of the engagement holes 32 with the provisional lock pawls 22. Thereafter when the spacer 7 is fully inserted, the spacer 7 causes the support plates 37 and 38 to abut against the horizontal support shoulders 30 of the inner housings 5 and 6 with the result that the inner housings are prevented from being tilted to ensure smooth engagement of the male connector 11 when the male connector 11 is inserted in the outer housing 1. As explained in the foregoing, the inner connector housings 5 and 6 are securely supported horizontally by the spacer 7 at the time of screw fastening the connectors, thus assuring smooth connector engagement.

What is claimed is:

1. A screw fastening type electrical connector assembly comprised of a first connector having first terminals and a nut therewithin and a second connector having second terminals and a bolt extending therethrough and adapted to be electrically connected to the first connector, said first connector comprising inner housing means having a support portion extending to perpendicularly cross an axial direction;

outer housing means having at least one accommodation chamber opening at first and second axial ends, said outer housing means receiving said inner housing means from said first axial end, said second axial end having a projection to stop said inner housing means, said outer housing means having a spacer insertion aperture in communication with said at least one accommodation chamber; and a spacer to be inserted into said accommodation chamber through said spacer insertion aperture to abut against said support portion and support said inner housing means in a direction perpendicular to said axial direction.

2. A screw fastening type electrical connector assembly according to claim 1, wherein said inner housing means includes two inner housings.

3. A screw fastening type electrical connector assembly according to claim 1, wherein said outer housing means includes an outer housing defined by two pairs of opposing walls extending axially.

4. A screw fastening type electrical connector assembly according to claim 3, wherein said spacer insertion aperture is formed in one of said opposing walls.

5. A screw fastening type electrical connector assembly according to claim 1, wherein said spacer and said outer housing means have provisional lock means and final lock means.

* * * * *